US009079290B2

(12) United States Patent
Esenwein

(10) Patent No.: US 9,079,290 B2
(45) Date of Patent: Jul. 14, 2015

(54) PORTABLE MACHINE TOOL

(75) Inventor: Florian Esenwein, Leinfelden-Echterdingen (DE)

(73) Assignee: Robert Bosch GmbH, Stuttgart, DE (US)

( * ) Notice: Subject to any disclaimer, the term of this patent is extended or adjusted under 35 U.S.C. 154(b) by 162 days.

(21) Appl. No.: 13/882,005

(22) PCT Filed: Sep. 21, 2011

(86) PCT No.: PCT/EP2011/066403

§ 371 (c)(1),
(2), (4) Date: Jul. 13, 2013

(87) PCT Pub. No.: WO2012/055643

PCT Pub. Date: May 3, 2012

(65) Prior Publication Data

US 2013/0288581 A1 Oct. 31, 2013

(30) Foreign Application Priority Data

Oct. 29, 2010 (DE) ..... 10 2010 043 182

(51) Int. Cl.

| | |
|---|---|
| ***B24B 27/00*** | (2006.01) |
| ***B24B 45/00*** | (2006.01) |
| ***B24B 23/02*** | (2006.01) |
| ***B24B 55/00*** | (2006.01) |
| ***B27B 5/32*** | (2006.01) |

(52) U.S. Cl.

CPC ..... *B24B 45/00* (2013.01); *B24B 23/028* (2013.01); *B24B 45/006* (2013.01); *B24B 55/00* (2013.01); *B27B 5/32* (2013.01)

(58) Field of Classification Search

CPC .... B24B 27/0084; B24B 41/00; B24B 27/00; B23F 23/1262; B23Q 5/40

USPC ..... 451/342–359, 363

See application file for complete search history.

(56) References Cited

U.S. PATENT DOCUMENTS

| | | | | |
|---|---|---|---|---|
| 5,056,268 | A * | 10/1991 | Wolff | 451/357 |
| 5,392,568 | A * | 2/1995 | Howard et al. | 451/357 |
| 5,464,365 | A * | 11/1995 | Kirn | 451/344 |
| 5,679,066 | A * | 10/1997 | Butz et al. | 451/357 |
| 6,132,300 | A * | 10/2000 | Martin | 451/357 |
| 6,394,884 | B1 * | 5/2002 | Wuensch | 451/357 |
| 7,052,384 | B2 * | 5/2006 | Wolf et al. | 451/358 |
| 8,096,857 | B2 * | 1/2012 | Hofmann et al. | 451/359 |
| 2002/0106982 | A1 * | 8/2002 | Wuensch | 451/357 |

(Continued)

FOREIGN PATENT DOCUMENTS

| | | |
|---|---|---|
| DE | 41 31 514 A1 | 3/1993 |
| DE | 10 2008 015 955 A1 | 8/2009 |

OTHER PUBLICATIONS

International Search Report corresponding to PCT Application No. PCT/EP2011/066403, mailed Feb. 6, 2012 (German and English language document) (5 pages).

*Primary Examiner* — George Nguyen

(74) *Attorney, Agent, or Firm* — Maginot, Moore & Beck LLP

(57) ABSTRACT

A portable machine tool, in particular a hand machine tool, has at least one spindle for receiving and for driving a processing tool, at least one brake unit for braking the spindle and/or the processing tool at least in a braking mode, and at least one runoff safety unit for preventing the processing tool from running off of the spindle at least in the braking mode.

11 Claims, 13 Drawing Sheets

(56) References Cited

U.S. PATENT DOCUMENTS

2002/0115394 A1* 8/2002 Krondorfer et al. ..... 451/342
2002/0193055 A1* 12/2002 Tiede et al. ..... 451/344
2004/0038622 A1* 2/2004 Dehde ..... 451/1
2005/0245182 A1* 11/2005 Deshpande et al. ..... 451/357
2006/0084370 A1* 4/2006 Robieu et al. ..... 451/359
2006/0276114 A1* 12/2006 Gallagher et al. ..... 451/344
2007/0072525 A1* 3/2007 Cheng ..... 451/358
2009/0308213 A1* 12/2009 Zaiser et al. ..... 81/488
2013/0288581 A1* 10/2013 Esenwein, Florian ..... 451/363

* cited by examiner

PORTABLE MACHINE TOOL

This application is a 35 U.S.C. §371 National Stage Application of PCT/EP2011/066403, filed on Sep. 21, 2011, which claims the benefit of priority to Serial No. DE 10 2010 043 182.6, filed on Oct. 29, 2010 in Germany, the disclosures of which are incorporated herein by reference in their entirety.

BACKGROUND

There are already known portable power tools that comprise a spindle for the purpose of receiving and driving a working tool. The portable power tools additionally have a braking unit, which is provided to brake the spindle and/or the working tool, at least when in a braking mode.

SUMMARY

The disclosure proposes a portable power tool, in particular a hand power tool, having at least one spindle for receiving and driving a working tool, having at least one braking unit, which is provided to brake the spindle and/or the working tool, at least when in a braking mode, and having at least one runoff safety unit, which is provided to prevent the working tool from running off the spindle, at least when in the braking mode. A "portable power tool" is to be understood here to be, in particular, a power tool, in particular a hand power tool, that can be transported by an operator without a transport machine. The portable power tool has, in particular, a mass of less than 50 kg, preferably less than 20 kg, and particularly preferably less than 10 kg. A "braking unit" is to be understood here to be, in particular, a unit provided to reduce and/or limit, at least substantially, a speed, in particular a rotational speed, of a moving component, in particular of a rotating component, in comparison with a working speed of the component. Preferably, the braking unit reduces and/or limits the speed in addition to a reduction and/or limitation of the speed caused purely by friction, resulting from a seating of the component. A "braking mode" is to be understood here to mean, in particular, a mode of the portable power tool, in particular the hand power tool, in which the spindle is braked by means of the braking unit, such that running-on of the spindle, as, for example, in the case of interruption of an electric power supply to an electric motor, can advantageously be prevented, at least to a large extent. In the case of the braking mode, mass moments of inertia of the working tool, in particular of a disk-shaped working tool, can result in a relative motion between the working tool fastened on the spindle, the runoff safety unit and a clamping nut provided to clamp the working tool on the spindle. The relative motion between the working tool and the clamping nut can result in the clamping nut becoming undone, and consequently being able to run off the spindle.

A "runoff safety unit" is to be understood here to mean, in particular, a unit that is provided to prevent, at least substantially, when in a braking mode, removal of a clamping force for clamping the working tool in an axial direction, and that is provided, in particular, to increase a clamping force acting upon the working tool when in a mounted state. An "axial direction" is to be understood here to mean, in particular, a direction running at least substantially parallelwise in relation to a rotation axis of the spindle. "Substantially parallelwise" is to be understood here to mean, in particular, an alignment of a direction relative to a reference direction, in particular in one plane, the direction deviating from the reference direction by, in particular, less than 8°, advantageously less than 5°, and particularly advantageously less than 2°. Preferably, the runoff safety unit is removably coupled to the spindle. "Removably" is to be understood here to mean, in particular, a decoupling of the runoff safety unit from the spindle, at least one function of the runoff safety unit, in particular a relative motion between at least two runoff safety elements of the runoff safety unit, being retained when in a decoupled state. Particularly preferably, the runoff safety unit is realized as a receiving flange. It is also conceivable, however, for the runoff safety unit to be realized as a clamping nut. The design according to the disclosure makes it possible, advantageously, to achieve a high degree of operational safety of the portable power tool. Further, advantageously, by means of the runoff safety unit according to the disclosure, it is possible to prevent the clamping nut from running off the spindle, and thereby to prevent the working tool from becoming detached from the spindle.

Furthermore, it is proposed that the portable power tool comprises a coding unit, which is provided to generate a coding, at least between the spindle and the runoff safety unit. A "coding unit" is to be understood here to mean, in particular, a unit provided to encipher an interface of the portable power tool between at least two components, in particular between the spindle and the runoff safety unit, in particular according to a key-and-keyhole principle. The interface between the spindle and the runoff safety unit is provided, in particular, to define an axial position of the runoff safety unit, in respect of a dimension of the spindle along the axial direction, on the spindle, and to define a concentric position of the runoff safety unit, in respect of a rotation axis of the spindle. Furthermore, the interface between the spindle and the runoff safety unit is provided, in particular, to transmit forces and/or torques from the spindle to the runoff safety unit. Preferably, the coding unit is provided to make it possible to mount components of a design that corresponds to the enciphered interface, in particular of a design for deciphering the enciphered interface. Further, the coding unit is preferably provided to make it impossible to mount components of a design that differs from the enciphered interface, in particular of a design unsuitable for deciphering the enciphered interface. A "component of a design that differs from the enciphered interface" is to be understood here to mean, in particular, a component having, at least substantially, dimensions that correspond to the spindle, in particular in respect of a receiving opening for receiving the spindle, and/or a thread size, and which is realized such that it is decoupled from an element that corresponds to the coding unit. The coding unit can further be provided to inhibit a drive moment for driving the spindle until a runoff safety unit, having a coding unit realized to decipher the enciphered interface, is mounted on the spindle. The coding unit in this case can be provided, for example, to generate a mechanical blocking of the spindle, until the runoff safety unit, having a coding unit realized to decipher the enciphered interface, is mounted on the spindle. Advantageously, it is possible to prevent a component of a design that differs from the enciphered interface, in particular a receiving unit decoupled from a runoff safety unit, from being mounted on the spindle that can be braked by means of the braking unit.

Advantageously, the coding unit is realized as a mechanical coding unit. A "mechanical coding unit" is to be understood here to mean, in particular, a unit that, by means of a form-closure connection, enciphers an interface between at least two components. Preferably, disposed on the spindle there is a coding element of the coding unit, which is realized so as to correspond to a further coding element of the coding unit that is disposed on the runoff safety unit. The coding element disposed on the spindle is realized, in particular, so as to be at least partially integral with the spindle. "Integral with" is to be understood here to mean, in particular, connected at least in a materially bonded manner, for example by a welding process, an adhesive bonding process, an injection process and/or by another process considered appropriate by persons skilled in the art, and/or, advantageously, formed in one piece, such as, for example, by being produced from a casting and/or by being produced in a single- or multi-component injection process and, advantageously, from a single blank. It is also conceivable, however, for the coding element to be detachably connected to the spindle, in a rotationally fixed manner, by means of a form-closure and/or force-closure connection. Preferably, the coding element disposed on the spindle, as viewed in a plane perpendicular to the rotation axis of the spindle, has a geometric shape that is other than a rectangle, having integrally formed-on circle segments on two opposing sides. Particularly preferably, the coding element disposed on the spindle, as viewed in the plane perpendicular to the rotation axis of the spindle, is realized as a circle segment. A "circle segment" is to be understood here to mean, in particular, a partial surface of a circular surface that is delimited by an arc and a chord. In this case, the further coding element, which is disposed on the runoff safety unit, is preferably constituted by an edge that delimits a recess, the recess, as viewed in a plane, having a shape corresponding to the circle segment. In addition, the further coding element is preferably realized so as to be at least partially integral with the runoff safety unit. It is also conceivable, however, for the further coding element to be detachably connected to the runoff safety unit, in a rotationally fixed manner, by means of a form-closure and/or force-closure connection. Particularly preferably, when the runoff safety unit is in a mounted state, the coding element disposed on the spindle preferably engages in the recess of the runoff safety unit and bears against the edge that delimits the recess of the runoff safety unit. A coding unit can be achieved through simple design means.

Further, it is proposed that at least one coding element of the coding unit has a geometric shape that has a basic circle and at least one coding structure projecting beyond the basic circle. A "basic circle" is to be understood here to mean, in particular, a circle that encloses a surface of the coding element along an angular range of 360°, the surface enclosed by the circle preferably being completely covered by a material of which the coding element is composed. In particular, at least three points of the basic circle are disposed on an outer wall of the coding element. The coding element is preferably realized so as to be at least partially integral with the spindle. The basic circle extends, in particular, in a plane perpendicular to the rotation axis of the spindle. Preferably, a center point of the basic circle lies on the rotation axis of the spindle. A "coding structure" is to be understood here to mean, in particular, a structure, in particular a geometric shape, that is part of an enciphered interface and that prevents a component of a design differing from the enciphered interface from being mounted. The coding structure is preferably provided to constitute a form-closure connection, by engaging in a further structure of a component of a design corresponding to the enciphered interface. The coding structure preferably extends along a radial direction of the basic circle, in particular going out from the center point of the basic circle, beyond the basic circle. Particularly preferably, the coding structure is realized so as to be at least partially integral with the surface enclosed by the basic circle. Further, the coding structure is preferably disposed in a region of the spindle that is provided to receive the runoff safety unit and/or to constitute a bearing contact surface of the spindle for the purpose of axially supporting the runoff safety unit. In an alternative design, the coding structure is disposed in a plane running parallelwise in relation to the surface enclosed by the basic circle. A radial extent of the coding structure in this case is preferably greater than a radial extent of the surface enclosed by the basic circle. In particular, the coding structure and the basic circle are connected to each other along the axial direction by means of a circumferential surface of the coding element. As a result, the coding structure, the basic circle and the circumferential surface constitute a truncated cone, which is realized so as to be integral with the spindle. Through simple design means, it is possible to achieve a coded interface that, advantageously, can transmit forces and/or torques from the spindle to the runoff safety unit.

In an alternative design of the portable power tool according to the disclosure, at least one coding element of the coding unit has at least one longitudinal recess for receiving a form-closure element of the coding unit. A "longitudinal recess" is to be understood here to mean, in particular, a material relief in the surface of a component, in particular the spindle, that has a main extent running along the axial direction. In particular, the component has a lesser thickness of material in the region of the longitudinal recess, in comparison with a region of the component that adjoins the longitudinal recess. The longitudinal recess is preferably constituted by a groove disposed in an outer wall of the spindle. Preferably, the form-closure element of the coding unit is realized as a parallel key and/or longitudinal pin that is disposed in the longitudinal recess. When the runoff safety unit is in a mounted state, the parallel key and/or longitudinal pin preferably engage/engages in the further coding element, which is disposed on the runoff safety unit. The further coding element in this case is realized as an edge of the runoff safety unit that delimits a groove realized so as to correspond to the parallel key and/or the longitudinal pin. Advantageously, a form-closure connection can be achieved for the purpose of coding the interface between the spindle and the runoff safety unit.

In a further alternative design of the portable power tool according to the disclosure, at least one coding element of the coding unit has at least one transverse recess for receiving a form-closure element of the coding unit. A "transverse recess" is to be understood here to mean, in particular, a material relief in a component, in particular the spindle, that has a main extent running transversely in relation to the axial direction. The main extent of the transverse recess runs, in particular, at least substantially perpendicularly in relation to the axial direction. The expression "substantially perpendicularly" is to be understood here to define, in particular, an orientation of a direction relative to a reference direction, the direction and the reference direction, in particular as viewed in one plane, enclosing an angle of 90°, and the angle having a maximum deviation of, in particular, less than 8°, advantageously less than 5°, and particularly advantageously less than 2°. The form-closure element of the coding unit is preferably realized as a transverse pin. Through simple design means, it is possible to achieve a coding unit that, advantageously, requires only a small structural space, in particular only a small axial structural space on the spindle.

It is furthermore proposed that the coding unit is realized as an electronic, electrical, optical, magnetic and/or electromagnetic coding unit. The coding unit in this case is preferably coupled to an open-loop and/or closed-loop control unit, which controls a starting of an electric motor unit of a drive unit of the portable power tool by open-loop and/or closed-loop control. An "open-loop and/or closed-loop control unit" is to be understood here to mean, in particular, a unit having at least an open-loop control device. An "open-loop control device" is to be understood to mean, in particular, a unit having a processor unit and having a memory unit, and having an operating program stored in the memory unit. Advantageously, it is possible to achieve a coding unit that, for example, by means of at least one indicator unit, can indicate to an operator whether a receiving unit of a design that differs from the enciphered interface, and/or of an unsuitable design, is being mounted. Further, advantageously, the electric motor unit of the drive unit can be prevented from starting if a receiving unit of a design that differs from the enciphered interface, and/or of an unsuitable design, has been mounted.

Preferably, the electronic coding unit has at least one RFID coding element, which is disposed on the runoff safety unit. The RFID coding element is realized, in particular, as an RFID transponder. Preferably, the portable power tool has an RFID read device, which is provided to read out a key and/or an identification of the RFID transponder. The RFID read device is preferably disposed in a power-tool housing of the portable power tool. Advantageously, enciphering of the interface can be achieved in a contactless manner.

Further, it is proposed that the braking unit is realized as a mechanical brake. Preferably, the braking unit has at least one friction lining, which is provided to brake the spindle when in a braking mode. A braking unit for braking the spindle can be achieved through simple design means.

In an alternative design of the portable power tool according to the disclosure, the braking unit is realized as an electromagnetic brake. Preferably, the braking unit in this case is realized as an eddy-current brake and/or as a hysteresis brake. It is also conceivable, however, for the braking unit to be realized as another electromagnetic brake, considered appropriate by persons skilled in the art. The electromagnetic brake preferably has at least one permanent magnet that, in at least one operating mode, generates a magnetic field that acts upon an eddy-current element and/or a hysteresis element. Advantageously, a braking unit that operates in a frictionless manner can be achieved.

Advantageously, the braking unit is realized as a mountable module. The expression "mountable module" is intended here to define, in particular, an assembly of a unit whereby a plurality of components are pre-mounted and the unit can be mounted as a whole in a complete system, in particular in the portable power tool. The mountable module preferably has at least one fastening element, which is provided to detachably connect the mountable module to the complete system. Advantageously, the mountable module can be demounted from the complete system, in particular, with fewer than 10 fastening elements, preferably with fewer than 8 fastening elements, and particularly preferably with fewer than 5 fastening elements. Particularly preferably, the fastening elements are realized as screws. It is also conceivable, however, for the fastening elements to be realized as other elements, considered appropriate by persons skilled in the art, such as, for example, as quick-action clamping elements, fastening elements that can be actuated without tools, etc. Preferably, at least one function of the mountable module can be realized when demounted from the complete system. Particularly preferably, the mountable module can be mounted and/or demounted by an end user. The mountable module is therefore realized as an exchangeable unit, which can be replaced by a further mountable module, such as, for example, in the case of a defect of the mountable module or an expansion of function and/or change of function of the complete system. The design of the braking unit as a mountable module makes it possible to achieve integration into already existing portable power tools, through simple design means. Furthermore, advantageously, production costs can be kept low as a result.

The disclosure is additionally based on a power tool system, in particular a hand power tool system, having a portable power tool according to the disclosure, and having at least one mountable module. It is proposed that the mountable module can be mounted on the portable power tool as an alternative to the braking unit, which is realized as a mountable module. Advantageously, a broad spectrum of application of the portable power tool can be achieved.

BRIEF DESCRIPTION OF THE DRAWINGS

Further advantages are given by the following description of the drawings. The shows drawings show exemplary embodiments of the disclosure. The drawings, the description and the claims contain numerous features in combination. Persons skilled in the art will also expediently consider the features individually and combine them to create appropriate further combinations.

In the drawing drawings.

DETAILED DESCRIPTION

Figure 1:
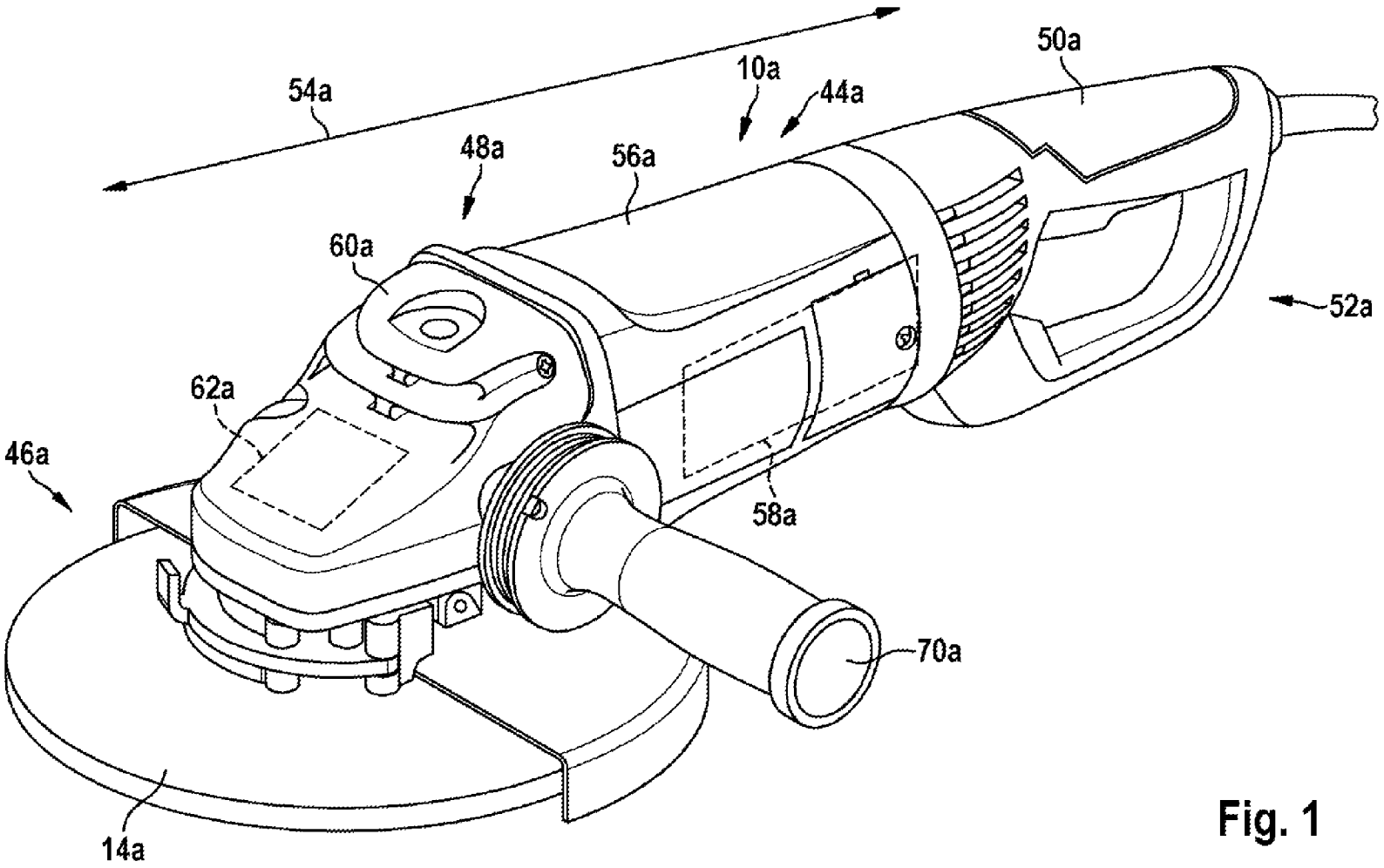
FIG. 1 shows a power tool according to the disclosure, in a schematic representation.
Figure 2:
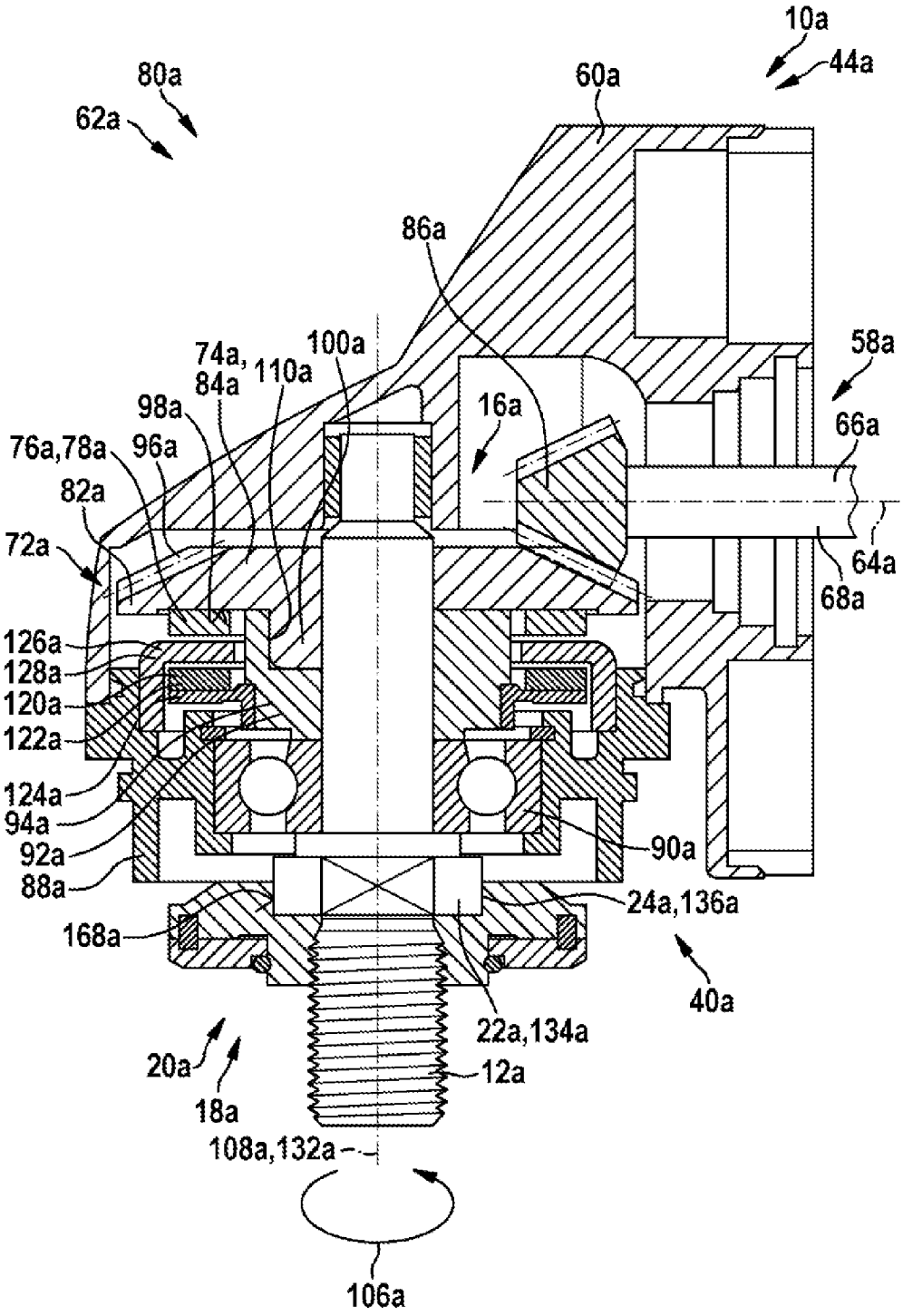
FIG. 2 shows a detail view of an arrangement of a braking unit according to the disclosure in the power tool according to the disclosure, in a schematic representation.

FIG. 1 shows a portable power tool 10*a*, realized as an angle grinder 44*a*. The angle grinder 44*a* comprises a protective hood unit 46*a*, a power-tool housing 48*a* and a main handle 50*a*, which extends, on a side 52*a* of the power-tool housing 48*a* that faces away from a working tool 14*a*, toward a direction of main extent 54*a* of the angle grinder 44*a*. The working tool 14*a* in this case is realized as a grinding disk. It is also conceivable, however, for the working tool 14*a* to be realized as a parting disk or polishing disk. The power-tool housing 48*a* comprises a motor housing 56*a* for receiving a drive unit 58*a* of the angle grinder 44*a*, and comprises a transmission housing 60*a* for receiving an output unit 62*a* of the angle grinder 44*a*. The drive unit 58*a* is provided to drive the working tool 14*a* in rotation, via the output unit 62*a*. The angle grinder 44*a* has a spindle 12*a* for receiving and driving the working tool 14*a* (FIG. 2). The output unit 62*a* is connected to the drive unit 58*a* via a drive element 66*a* of the drive unit 58*a* that is driven in rotation about a rotation axis 64*a*. The drive element 66*a* is realized as an armature shaft 68*a* (FIG. 2). An ancillary handle 70*a* is disposed on the transmission housing 60*a*. The ancillary handle 70*a* extends transversely in relation to the direction of main extent 54*a* of the angle grinder 44*a*.

FIG. 2 shows an arrangement of a braking unit 16*a* of the angle grinder 44*a* in the transmission housing 60*a*. The braking unit 16*a* is realized as an electromagnetic brake. The braking unit 16*a* is provided to brake the spindle 12*a* and/or the working tool 14*a*, when in a braking mode. Further, the angle grinder 44*a* has a runoff safety unit 18*a*, which is provided to prevent the working tool 14*a* from running off the spindle 12*a*, when in the braking mode. The runoff safety unit 18*a* has a motion change unit (not represented in greater detail here), which is provided to change a first relative motion between two runoff safety elements (not represented in greater detail here) into a second relative motion, in the braking mode. An axial clamping force for clamping the working tool 14*a* can therefore be increased in the braking mode. Further, the runoff safety unit 18*a* is realized as a receiving flange, which is connected to the spindle 12*a* in a rotationally fixed manner by means of a form closure. It is also conceivable, however, for the receiving flange to be connected to the spindle 12*a* in a rotationally fixed manner by means of other types of connection, considered appropriate by persons skilled in the art. The braking unit 16*a* additionally has a mechanical activating unit 72*a*. The activating unit 72*a* is provided to change a characteristic quantity of a magnetic field of the electromagnetic brake as a result of a relative motion.

The output unit 62*a* of the angle grinder 44*a* comprises an output element 74*a*, on which there is disposed at least one braking element 78*a* of the braking unit 16*a* that is realized as a first permanent magnet 76*a*. The output unit 62*a* is realized as a bevel gear transmission 80*a*, which is coupled to the drive unit 58*a* of the angle grinder 44*a* for the purpose of transmitting torque. The braking unit 16*a* is disposed, along a flow of force going out from the drive unit 58*a*, behind a transmission input gear wheel 82*a* of the bevel gear transmission 80*a*. The output element 74*a* in this case is realized as a ring gear 84*a*. When the output unit 62*a* is in a mounted state, the ring gear 84*a* is in engagement with a pinion gear 86*a* of the drive unit 58*a*. The transmission input gear wheel 82*a* is therefore constituted by the ring gear 84*a*.

The output unit 62*a* additionally comprises the rotatably mounted spindle 12*a*, a bearing flange 88*a*, a bearing element 90*a* that is disposed in the bearing flange 88*a*, and an output element 92*a*, which is coupled to the spindle 12*a* in a rotationally fixed manner and which is realized as a driving element 94*a*. The ring gear 84*a* is disposed on the spindle 12*a* by means of a clearance fit. The bearing flange 88*a* is detachably connected to the transmission housing 60*a* by means of fastening elements (not represented in greater detail here) of the output unit 62*a*. Further, the working tool 14*a* can be connected to the spindle 12*a* in a rotationally fixed manner by means of a clamping element (not represented in greater detail here) for the purpose of performing work on a workpiece. The working tool 14*a* can therefore be driven in rotation when the angle grinder 44*a* is in operation.

Figure 3:
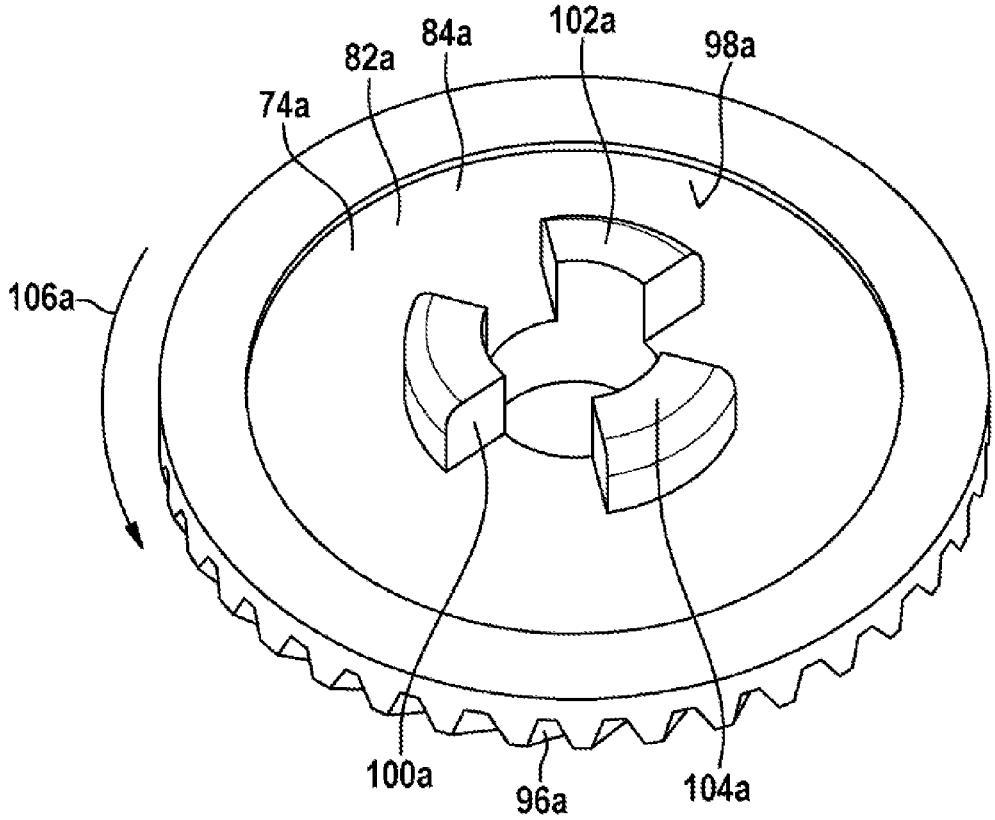
FIG. 3 shows a detail view of a braking element of the braking unit according to the disclosure, in a schematic representation.

FIG. 3 shows a detail view of the ring gear 84*a* of the output unit 62*a*. The ring gear 84*a* is composed of a magnetically conducting material such as, for example, a ferromagnetic material. As a result, a magnetic field can be compressed in the region of the ring gear 84*a*, and leakages fluxes can be kept small. Furthermore, on a side 98*a* of the ring gar 84*a* that faces away from a toothing 96*a* of the ring gear 84*a*, the ring gear 84*a* has three rotary driving elements 100*a*, 102*a*, 104*a*. It is also conceivable, however, for the ring gear 84*a* to have a number of rotary driving elements 100*a*, 102*a*, 104*a* that is other than three. Depending on the field of application, persons skilled in the art will provide an appropriate number of rotary driving elements 100*a*, 102*a*, 104*a* on the ring gear 84*a*. The rotary driving elements 100*a*, 102*a*, 104*a* are disposed, in a uniformly distributed manner along a circumferential direction 106*a*, on the side 98*a* of the ring gear 84*a* that faces away from the toothing 96*a*. The circumferential direction 106*a* in this case extends in a plane running perpendicularly in relation to a rotation axis 108*a* of the ring gear 84*a*. During operation, for the purpose of transmitting torques to the working tool 14*a*, the ring gear 84*a* rotates about the rotation axis 108*a*. Further, the rotary driving elements 100*a*, 102*a*, 104*a* extend perpendicularly in relation to the side 98*a* of the ring gear 84*a* that faces away from the toothing 96*a*. When the output unit 62*a* is in a mounted state, the rotary driving elements 100*a*, 102*a*, 104*a* extend in the direction of the driving element 94*a* (FIG. 2).

Figure 5:
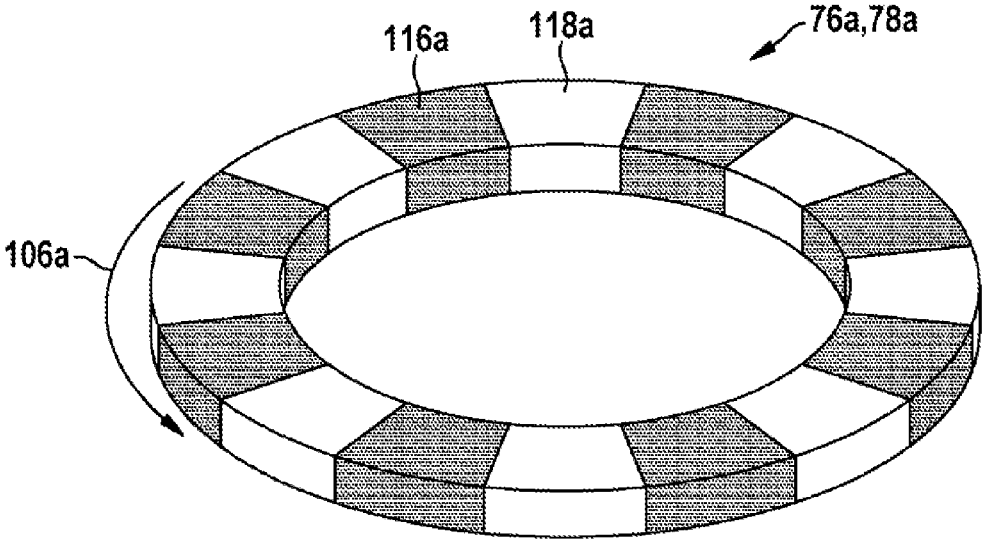
FIG. 5 shows a detail view of a further braking element, realized as a permanent magnet, of the braking unit according to the disclosure, in a schematic representation.

The first permanent magnet 76*a*, which is connected to the ring gear 84*a* in a rotationally fixed manner, is realized in the form of an annulus (FIG. 5). The first permanent magnet 76*a* is disposed on the side 98*a* of the ring gear 84*a* that faces away from the toothing 96*a*. Further, the first permanent magnet 76*a* has angular segments 116*a*, 118*a* distributed in a uniform manner along the circumferential direction 106*a*. The angular segments 116*a*, 118*a* have polarities that alternate relative to each other along the circumferential direction 106*a*. The polarities alternate continuously, along the circumferential direction 106*a*, between magnetic north pole and magnetic south pole. The braking unit 16*a* has a further braking element 122*a*, realized as a second permanent magnet 120*a*. The second permanent magnet 120*a* is realized in the form of an annulus, and has angular segments (not represented in greater detail here) distributed in a uniform manner along the circumferential direction 106*a*. Further, the second permanent magnet 120*a* is disposed in a rotationally fixed manner on the driving element 94*a*, by means of a return element 124*a*. The return element 124*a* is provided to compress a magnetic field of the braking unit 16*a* in the region of the braking unit 16*a*, and to keep leakages fluxes small.

Furthermore, the braking unit 16*a* has a further braking element 126*a*, which is realized as an eddy-current element 128*a*. The braking unit 16*a* is therefore realized as an eddy-current brake. It is also conceivable, however, for the braking unit 16*a* to have a braking element realized as a hysteresis element, as an alternative to the eddy-current element 128*a*, and therefore to be realized as a hysteresis brake. The eddy-current element 128*a* is composed of an electrically conductive material such as, for example, aluminum and/or copper. Further, the eddy-current element 128*a* is disposed axially between the first permanent magnet 76*a* and the second permanent magnet 120*a*, along the rotation axis 108*a* of the ring gear 84*a*. The eddy-current element 128*a* is fixedly connected to the bearing flange 88*a*. Therefore, when the angle grinder 44*a* is in operation, the first permanent magnet 76*a* and the second permanent magnet 120*a* are moved relative to the eddy-current element 128*a* by means of the spindle 12*a*. In order to prevent a magnetic short circuit, the driving element 94*a* and the spindle 12*a* are composed of a non-magnetisable material such as, for example, high-grade steel, etc.

Figure 4:
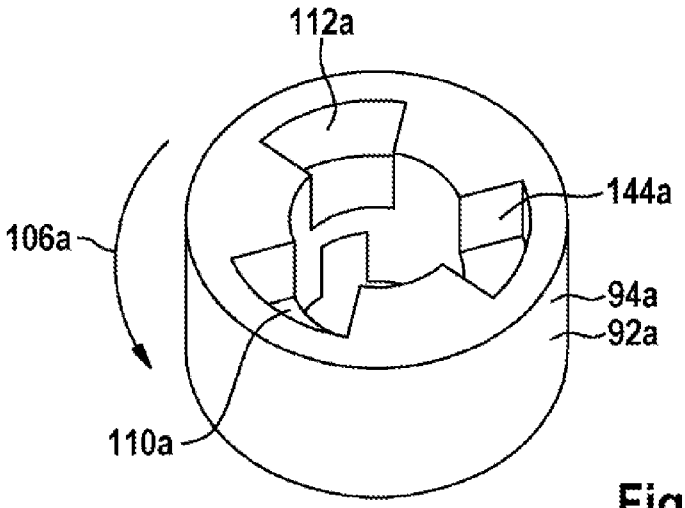
FIG. 4 shows a detail view of a further braking element of the braking unit according to the disclosure, in a schematic representation.

FIG. 4 shows a detail view of the driving element 94*a*. For the purpose of receiving the rotary driving elements 100*a*, 102*a*, 104*a*, the driving element 94*a* has three rotary driving recesses 110*a*, 112*a*, 114*a*. When in a mounted state, therefore, the rotary driving elements 100*a*, 102*a*, 104*a* extend, along the rotation axis 108*a* of the ring gear 84*a*, into the rotary driving recesses 110*a*, 112*a*, 114*a*. The rotary driving recesses 110*a*, 112*a*, 114*a* are disposed, distributed in a uniform manner along the circumferential direction 106*a*, on the driving element 94*a*. Further, the rotary driving recesses 110*a*, 112*a*, 114*a* have a greater extent along the circumferential direction 106*a*, in comparison with the rotary driving elements 100*a*, 102*a*, 104*a*. A rotary play is achieved between the ring gear 84*a* and the driving element 94*a*, along the circumferential direction 106*a*. The rotary play is constituted by an angular range by which the ring gear 84*a* can be rotated relative to the driving element 94*a*. The angular range in this case is constituted by a circle circumference of 360°, divided by the number of poles of the permanent magnets 76*a*, 120*a*. The rotary driving elements 100*a*, 102*a*, 104*a* can therefore be moved along the circumferential direction 106*a*, in the rotary driving recesses 110*a*, 112*a*, 114*a*, relative to edge regions of the rotary driving recesses 110*a*, 112*a*, 114*a*. When the rotary driving elements 100*a*, 102*a*, 104*a* bear against edge regions of the rotary driving recesses 110*a*, 112*a*, 114*a*, the driving element 94*a* couples the ring gear 84*a* to the spindle 12*a* in a rotationally fixed manner. The relative motion of the ring gear 84*a* relative to the driving element 94*a* is used by the activating unit 72*a* to change a characteristic quantity of a magnetic field of the braking unit 16*a*. It is also conceivable, however, for the rotary driving elements 100*a*, 102*a*, 104*a* to be disposed on the driving element 94*a*, and for the rotary driving recesses 110*a*, 112*a*, 114*a* to be disposed on the ring gear 84*a*. The rotary driving elements 100*a*, 102*a*, 104*a* of the ring gear 84*a* and the rotary driving recesses 110*a*, 112*a*, 114*a* of the driving element 94*a* constitute the mechanical activating unit 72*a*.

When the angle grinder 44*a* is in an inactive state, the braking unit 16*a* is in a braking mode. In the braking mode, respectively opposing polarities of the angular segments 116*a*, 118*a* of the first permanent magnet 76*a* and of the angular segments of the second permanent magnet 120*a*, as viewed along the rotation axis 108 of the ring gear 84*a*, are opposite each other. When the angle grinder 44*a* is put into operation through energizing of the electric motor of the drive unit 58*a*, the ring gear 84*a* is driven by the pinion gear 86*a*. In this case, the ring gear 84*a* is rotated about the rotation axis 108*a*, relative to the driving element 94*a*, until the rotary driving elements 100*a*, 102*a*, 104*a* bear against edge regions of the rotary driving recesses 110*a*, 112*a*, 114*a*. As a result, the ring gear 84*a* is coupled to the spindle 12*a* in a rotationally fixed manner. Consequently, the spindle 12*a* is driven in rotation. The working tool 14*a* fastened to the spindle 12*a* is therefore likewise driven in rotation. When the angle grinder 44*a* is in operation, small magnetic forces act upon the eddy-current element 128*a*. In order to reduce the magnetic forces, it is also conceivable for the permanent magnets 76*a*, 120*a* to be moved translationally relative to each other, in addition to the rotation relative to each other, by means of the activation unit 72*a*, along the rotation axis 108*a*. In this case, a distance between the permanent magnets 76*a*, 120*a* can be altered. For example, a groove, having a mathematically defined pitch along the rotation axis 108, can be provided on the spindle 12*a*. A travel element, for example, could engage in the groove. A relative motion about the rotation axis 108*a* of the ring gear 84*a* could cause the first permanent magnet 76*a* to be moved in a direction oriented away from the driving element 94*a*, relative to the second permanent magnet 120*a*.

The first permanent magnet 76*a* is rotated relative to the second permanent magnet 120*a* as a result of the relative motion between the ring gear 84*a* and the driving element 94*a*. As a result, the braking unit 16*a* is switched to an operating mode, in which small magnetic forces of the braking unit 16*a* act upon the eddy-current element 128*a*. In a transition from a braking mode to an operating mode, the activating unit 72*a* changes a pole position of the first permanent magnet 76*a* relative to the second permanent magnet 120*a* of the braking unit 16*a*. In operating mode, therefore, same-direction polarities of the angular segments 116*a*, 118*a* of the first permanent magnet 76*a* and of the angular segments of the second permanent magnet 120*a* are opposite each other, as viewed along the rotation axis 108*a* of the ring gear 84*a*.

Upon switch-off of the angle grinder 44*a*, the pinion gear 86*a* is braked by the electric motor unit. The working tool 14*a* fastened to the spindle continues to rotate, owing to a mass inertia. The spindle 12*a*, likewise, therefore continues to be rotated about the rotation axis 108*a*. The working tool 14*a* has greater mass moments of inertia, in comparison with the pinion gear 86*a*. The pinion gear 86*a* therefore brakes the ring gear 84*a*. The ring gear 84*a* is rotated about the rotation axis 108*a*, relative to the driving element 94*a*, until the rotary driving elements 100*a*, 102*a*, 104*a* bear against edge regions of the rotary driving recesses 110*a*, 112*a*, 114*a*. The braking unit 16*a* in this case is switched to a braking mode. The two permanent magnets 76*a*, 120*a* are rotated relative to each other. The first permanent magnet 76*a* in this case is rotated relative to the second permanent magnet 120*a*, until opposite-direction polarities of the angular segments 116*a*, 118*a* of the first permanent magnet 76*a* and of the angular segments of the second permanent magnet 120*a* are opposite each other, as viewed along the rotation axis 108*a* of the ring gear 84*a*. As a result, a voltage is induced in the eddy-current element 128*a*. The induced voltage causes current to flow perpendicularly and in an eddying manner in relation to a magnetic flux of the braking unit 16*a*. In this, eddy currents are formed. The eddy currents generate in the eddy-current element 128*a* a magnetic field that opposes a magnetic field of the permanent magnets 76*a*, 120*a*. As a result, a braking moment is generated, which brakes the permanent magnets 76*a*, 120*a*, which are rotating with the spindle 12*a*, relative to the eddy-current element 128*a*. The spindle 12*a* and the working tool 14*a* are therefore likewise braked. A strength of the magnetic field of the braking unit 16*a*, and thus a propagation of a magnetic flux of the braking unit 16*a* for generating the braking moment, is dependent on a distance along the rotation axis 108*a*, between the first permanent magnet 76*a* and the second permanent magnet 120*a*, and on a pole position along the circumferential direction 106*a* of the first permanent magnet 76*a* and of the second permanent magnet 120*a* relative to each other.

Figure 6:
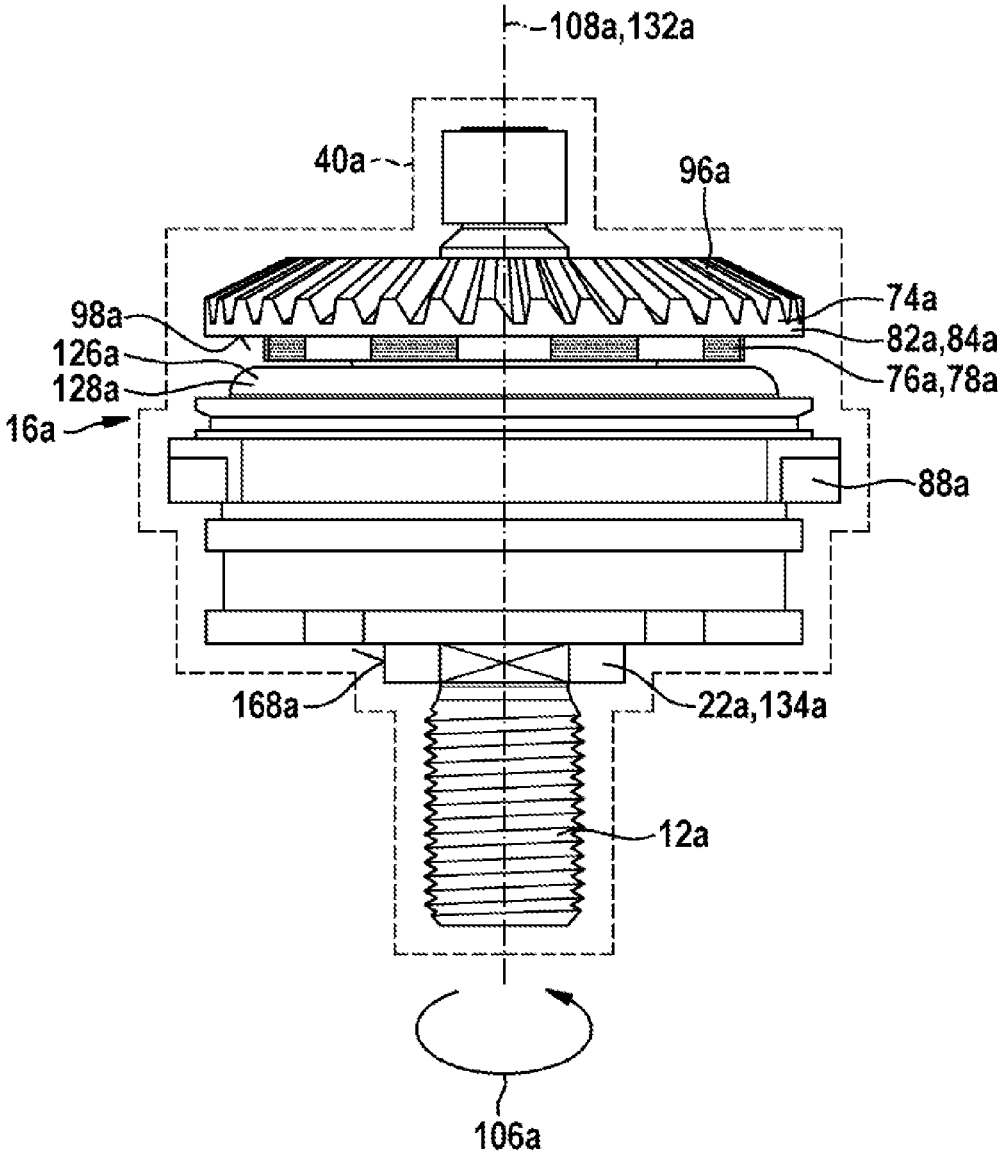
FIG. 6 shows a detail view of the braking unit, realized as a mountable module, for mounting on the power tool from FIG. 1, in a schematic representation.
Figure 7:
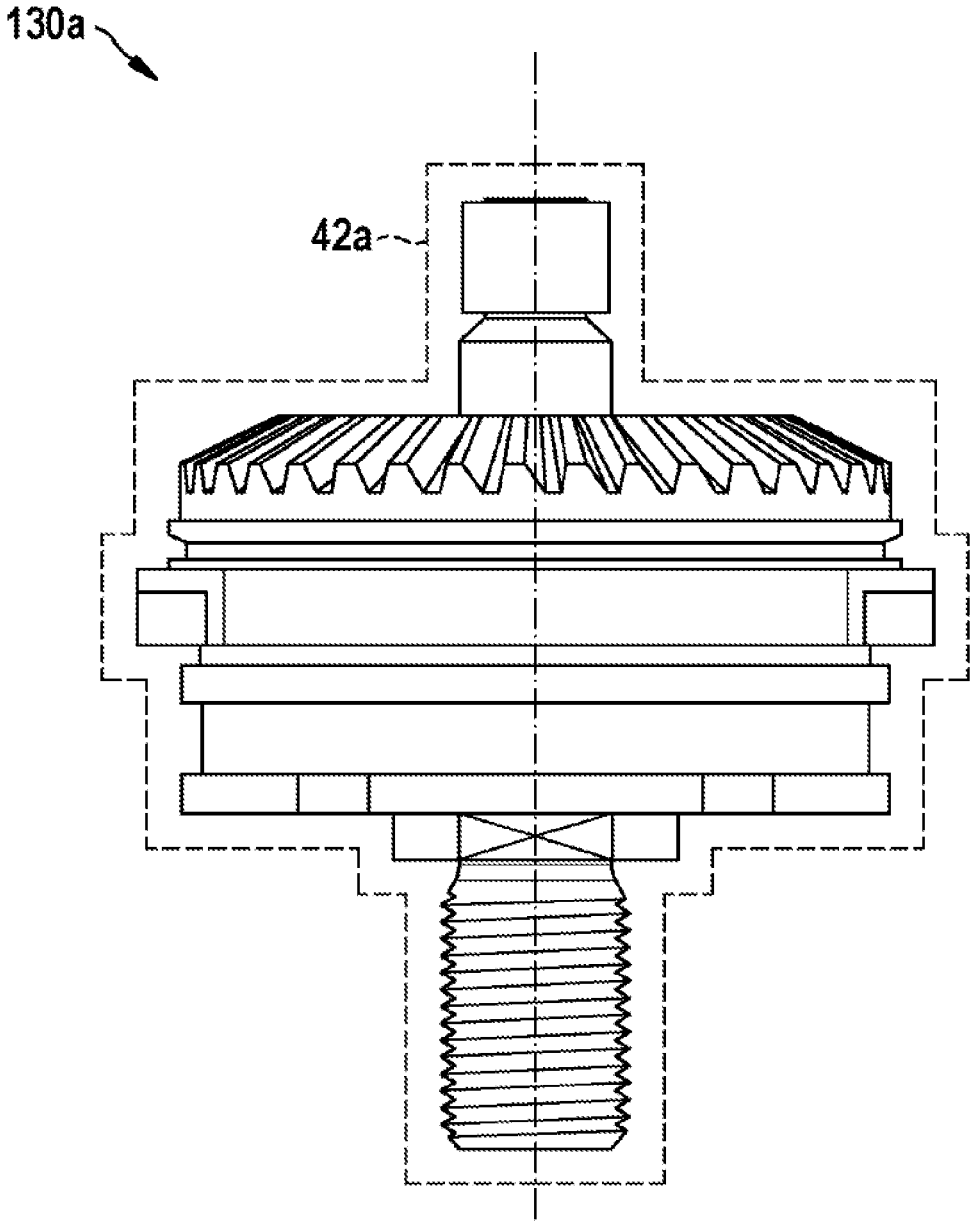
FIG. 7 shows a detail view of an additional mountable module for alternative mounting on the power tool from FIG. 1, in a schematic representation.

Furthermore, the braking unit 16*a*, together with the output unit 62*a*, is realized as a mountable module 40*a* (FIG. 6). The mountable module 40*a* comprises four fastening elements (not represented here), realized as screws. The screws are provided for detachably connecting the mountable module 40*a* to the transmission housing 60*a*. If necessary, an operator can demount the mountable module 40*a* from the transmission housing 60*a*. The angle grinder 44*a* and the mountable module 40*a* thus constitute a power tool system. The power tool system comprises a further mountable module 42*a* (FIG. 7). The further mountable module 42*a* comprises an output unit 130*a*, realized as a bevel gear transmission and decoupled from a braking unit. The further mountable module 42*a* can be mounted on the transmission housing 60*a*, as an alternative to the mountable module 40*a*, by the operator. It is thus possible for an operator to equip the angle grinder 44*a* with a mountable module 40*a* having a braking unit 16*a* and an output unit 62*a*, or with a mountable module 42*a* having an output unit 130*a*. For an application in which the angle grinder 44*a* is to be operated when decoupled from the braking unit 16*a*, the mountable module 40*a* can be replaced, by an operator, by the further mountable module 42 of the power tool system. For this purpose, the operator merely demounts the mountable module 40*a* from the transmission housing 60*a* and mounts the further mountable module 42*a* on the transmission housing 60*a*.

In an alternative realization of the portable power tool 10*a*, realized as an angle grinder 44*a*, it is conceivable for the power tool 10*a* to have, in addition to the braking unit 16*a*, a further braking unit that is disposed in the motor housing 56*a* of the angle grinder 44*a*. Further, it is conceivable for the angle grinder 44*a* to comprise a cooling unit, which is provided to remove from the braking unit 16*a* heat that is produced in the braking mode as a result of an internal friction of the eddy-current element 128*a*. Further, it is conceivable for the braking unit 16*a* to have an electromagnet. The electromagnet can be provided to enable an additional torque to be achieved during start-up of the drive unit 58*a*, in order for the electric motor unit to achieve a working rotational speed within a short time span, such as, preferably, in order to achieve booster operation. It is also conceivable, however, for the electromagnet to be provided to intensify a magnetic field of the permanent magnets 76*a*, 120*a*. As a result, a strong braking moment can be achieved, for the purpose of braking the rotating permanent magnets 76*a*, 120*a*. The electromagnet in this case can be coupled, for example, to a safety unit, which activates the electromagnet, for example, in the event of rupture of the working tool 14*a*, in order to prevent the spindle 12*a* of the angle grinder 44*a* from continuing to rotate.

Figure 8:
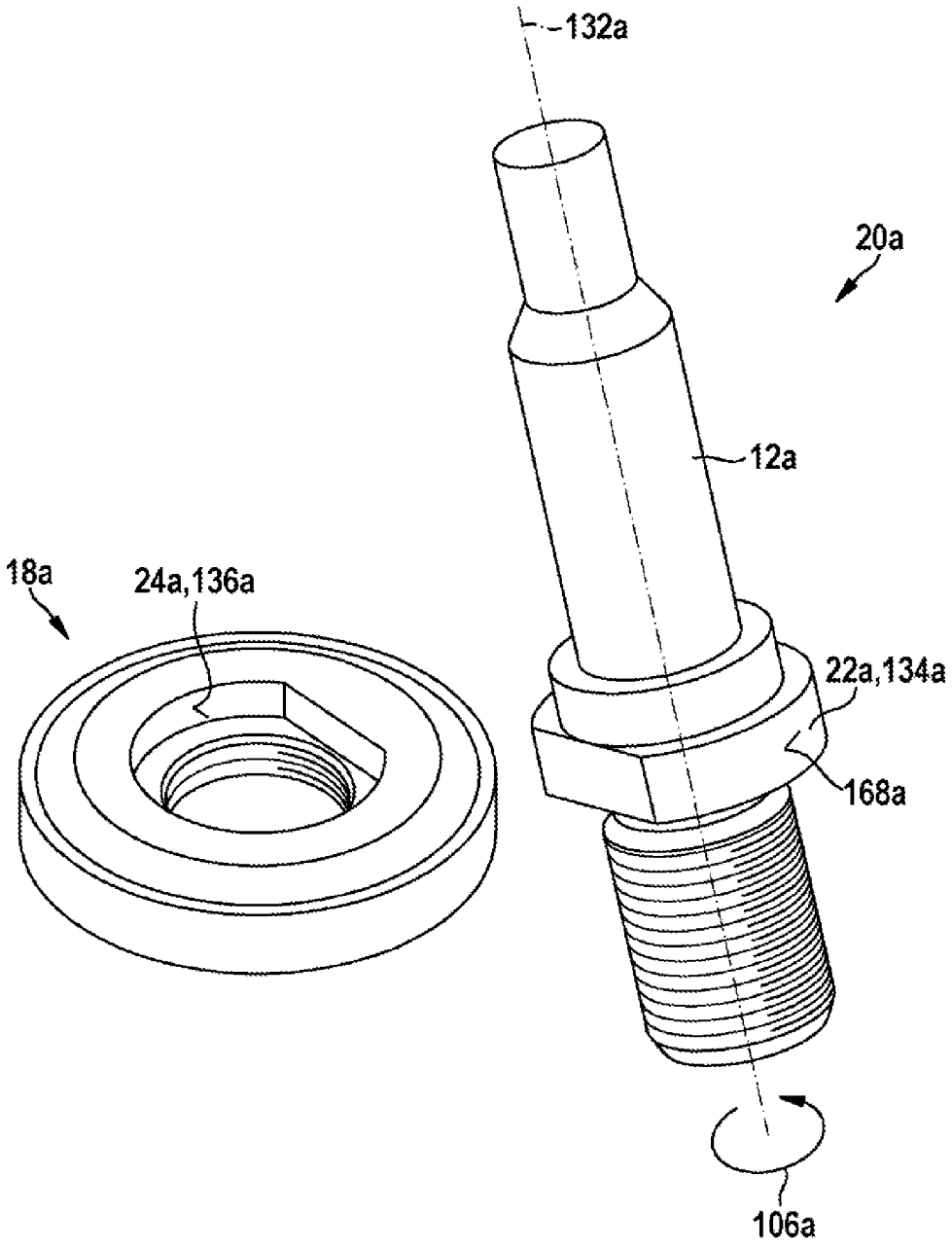
FIG. 8 shows a detail view of a spindle and of a runoff safety unit of the power tool according to the disclosure, which are each realized so as to be integral with a coding element of the coding unit, in a schematic representation.

Furthermore, the portable power tool 10*a*, realized as an angle grinder 44*a*, has a coding unit 20*a*, which is provided to generate a coding between the spindle 12*a* and the runoff safety unit 18*a* that can be mounted on the spindle 12*a* (FIG. 2). The coding unit 20*a* is realized as a mechanical coding unit 20*a*. The coding unit 20*a* has a first coding element 22*a*, which is realized so as to be integral with the spindle 12*a*. The first coding element 22*a*, as viewed in a plane perpendicular to a rotation axis 132*a* of the spindle 12*a*, is realized as a circle segment 134*a*. When the spindle 12*a* is in a mounted state, the rotation axis 132*a* of the spindle 12*a* runs coaxially in relation to the rotation axis 108*a* of the ring gear 84*a*. The coding unit 20*a* additionally has a second coding element 24*a*, which is realized so as to be integral with the runoff safety unit 18*a* (FIG. 8). The second coding element 24*a* in this case is realized as an edge 136*a* that delimits a recess of the runoff safety unit 18*a*. When the runoff safety unit 18*a* is in a mounted state, the recess of the runoff safety unit 18*a*, as viewed in a plane perpendicular to the rotation axis 132*a* of the spindle 12*a*, has a shape that corresponds to the circle segment 134*a*. When the runoff safety unit 18*a* has been mounted on the spindle 12*a*, the edge 136*a* that delimits the recess of the runoff safety unit 18*a* bears against an outer circumference 168*a* of the circle segment 134*a*. When in a mounted state, the circle segment 134*a* and the edge 136*a* that delimits the recess of the runoff safety unit 18*a* therefore constitute a form-closure connection. The outer circumference 168*a* of the circle segment 134*a* extends along the circumferential direction 106*a*, which runs in a plane perpendicular to the rotation axis 132*a* of the spindle. The coding unit 20*a* makes it possible to prevent components that have a recess of a shape differing from the shape of the circle segment 134*a* from being mounted on the spindle 12*a*.

FIGS. 9 to 20 show alternative exemplary embodiments. Components, features and functions that remain substantially the same are denoted, basically, by the same references. In order to differentiate the exemplary embodiments, the references of the exemplary embodiments have the suffix letters a to k. The description that follows is limited substantially to the differences in relation to the first exemplary embodiment in FIGS. 1 to 8, and reference may be made to the description of the first exemplary embodiment in FIGS. 1 to 8 in respect of components, features and functions that remain the same.

Figure 9:
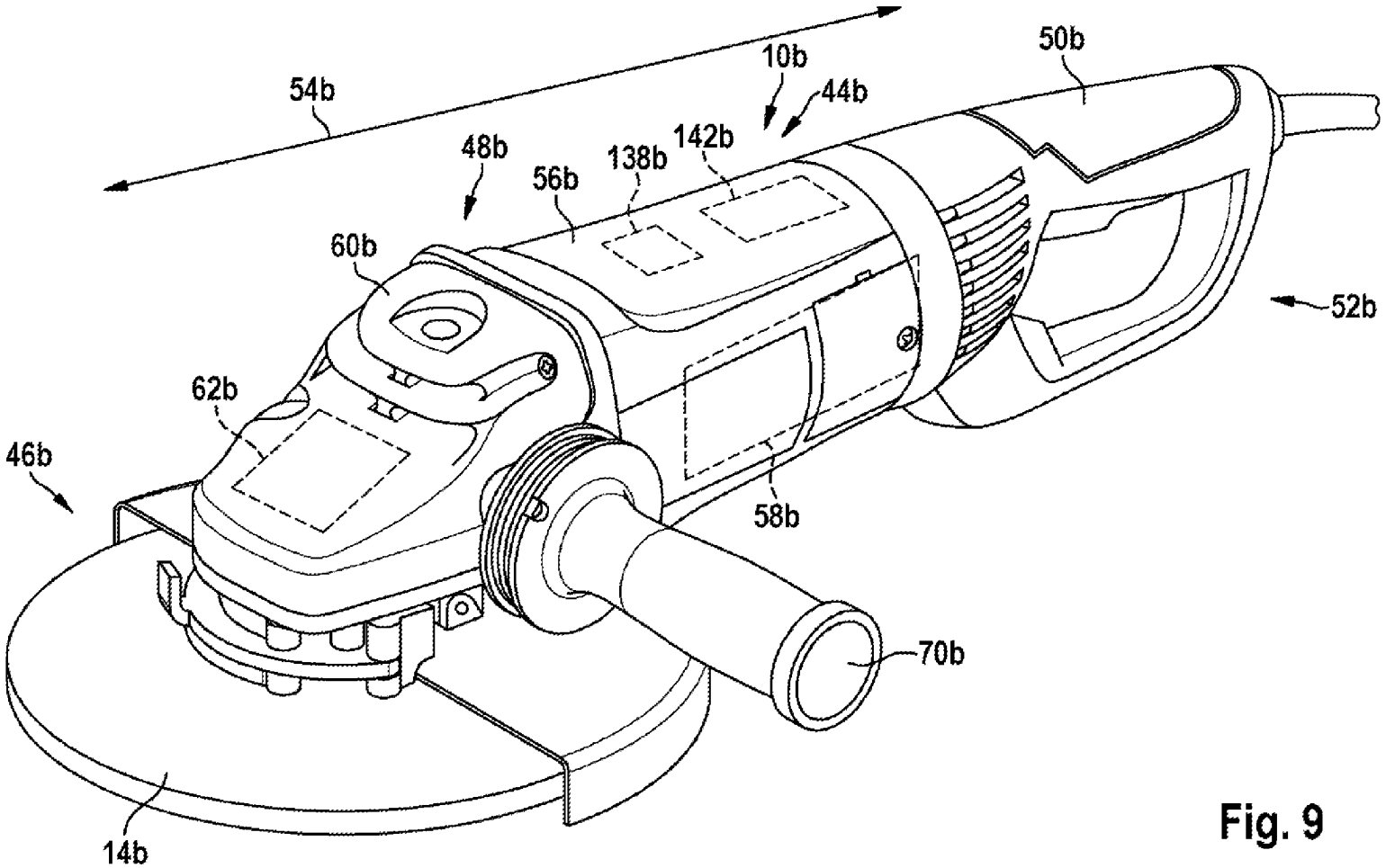
FIG. 9 shows an alternative power tool according to the disclosure, in a schematic representation.
Figure 10:
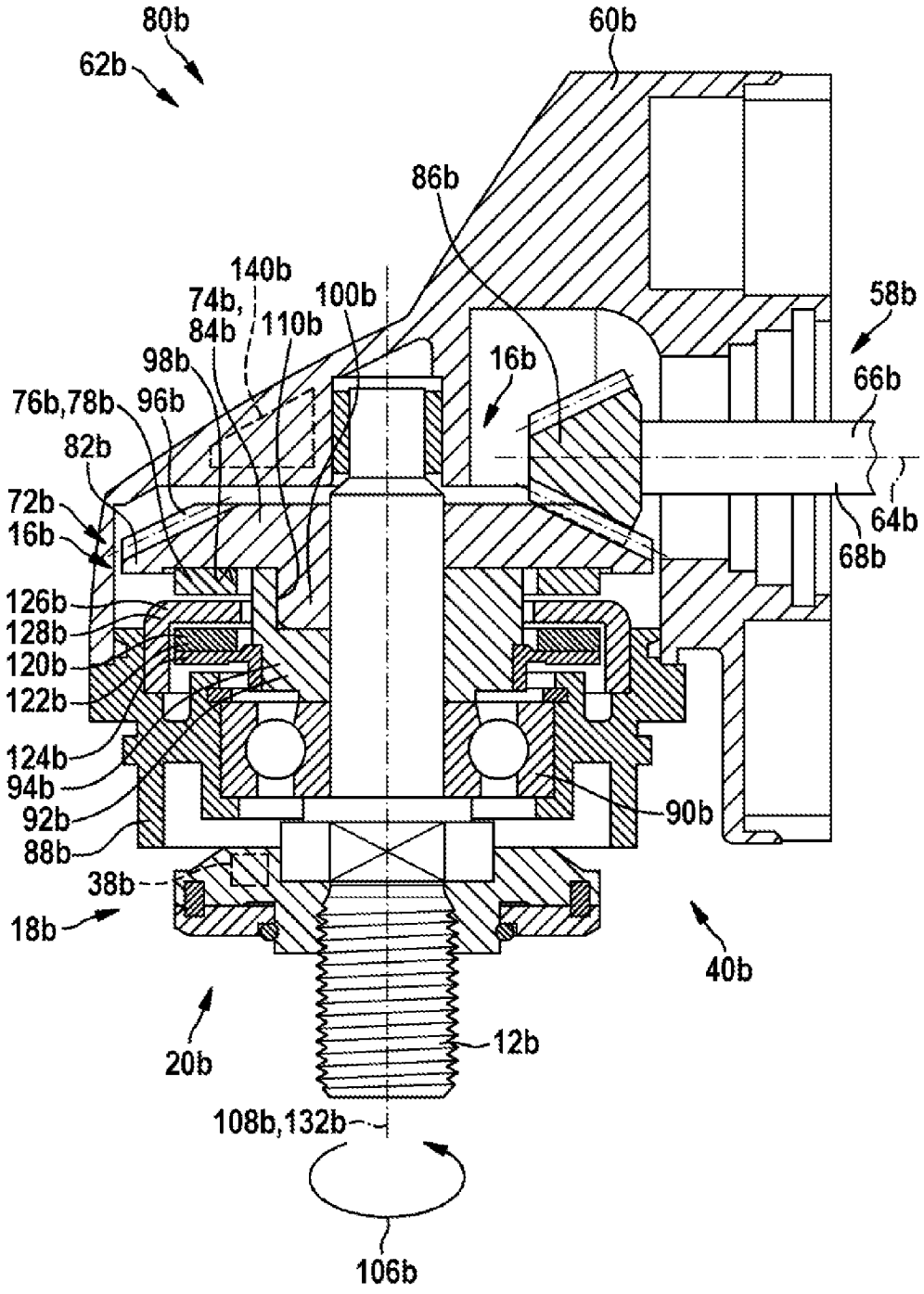
FIG. 10 shows a detail view of an arrangement of an alternative braking unit according to the disclosure in the power tool according to the disclosure and of an alternative coding unit according to the disclosure, in a schematic representation.

FIG. 9 shows a portable power tool 10*b* that is realized as an angle grinder 44*b*. The angle grinder 44*b* is of a structure that is substantially similar to the angle grinder 44*a* from FIG. 1. Further, the angle grinder 44*b* has a coding unit 20*b*, which is provided to generate a coding between a spindle 12*b* of the angle grinder 44*b* and a runoff safety unit 18*b* of the angle grinder 44*b*. The coding unit 20*b* is realized as an electromagnetic coding unit 20*b*. In this case, the coding unit 20*b* has an RFID coding element 38*b*, which is disposed on the runoff safety unit 18*b* (FIG. 10). The RFID coding element 38*b* is realized as an RFID transponder. Furthermore, the coding unit 20*b* has an RFID read device 140*b*, which is disposed in a transmission housing 60*b* of the angle grinder 44*b*. The RFID read device 140*b* is provided to read out a key and/or an identification from the RFID coding element 38*b*. The coding unit 20*b* is connected to an open-loop and/or closed-loop control unit 142*b* of the angle grinder 44*b*. If the runoff safety unit 18*b*, together with the RFID coding element 38*b*, having in a memory a key that is admissible for the coding unit 20*b*, is mounted on the spindle 12*b*, the angle grinder 44*b* can be put into operation. Energizing of an electric motor unit (not represented in greater detail here) is enabled by means of the open-loop and/or closed loop control unit 142*b*. If a receiving unit that is decoupled from an RFID coding element and/or has an RFID coding element having a key that is inadmissible for the coding unit 20*b* is mounted on the spindle 12*b*, start-up of the angle grinder 44*b* is prevented by means of the open-loop and/or closed-loop control unit 142*b*.

Further, the angle grinder 44*b* has an indicator unit 138*b* (FIG. 9). The indicator unit 138*b* is provided to indicate to an operator that the angle grinder 44*b* is ready for operation, as a result of the runoff safety unit 18*b* having been mounted on the spindle 12*b*. If a receiving unit that is decoupled from an RFID coding element and/or that has an RFID coding element having a key that is inadmissible for the coding unit 20*b* is mounted on the spindle 12*b*, the indicator unit 138*b* indicates to an operator that start-up of the angle-grinder 44*b* is prevented by means of the open-loop and/or closed-loop control unit. The indicator unit 138*b* can be constituted by analog indicating means such as, for example, a pointer or the like, and/or by electronic indicating means such as, for example, LEDs or an LC display, etc. The angle grinder 44*b* furthermore comprises a braking unit 16*b*, which has a structure similar to the braking unit 16*b* from FIG. 2. In respect of functioning of the braking unit 16*b*, therefore, reference may be made to the description of FIGS. 2 to 8.

Furthermore, the braking unit 16*b*, together with the output unit 62*b*, is realized as a mountable module 40*b*. The mountable module 40*b* comprises four fastening elements (not represented here), realized as screws. The screws are provided for detachably connecting the mountable module 40*b* to the transmission housing 60*b*. If necessary, an operator can demount the mountable module 40*b* from the transmission housing 60*b*. The angle grinder 44*b* and the mountable module 40*b* thus constitute a power tool system. The power tool system comprises a further mountable module (not represented in greater detail here). The further mountable module can be mounted on the transmission housing 60*b*, as an alternative to the mountable module 40*b*, by the operator.

Figure 11:
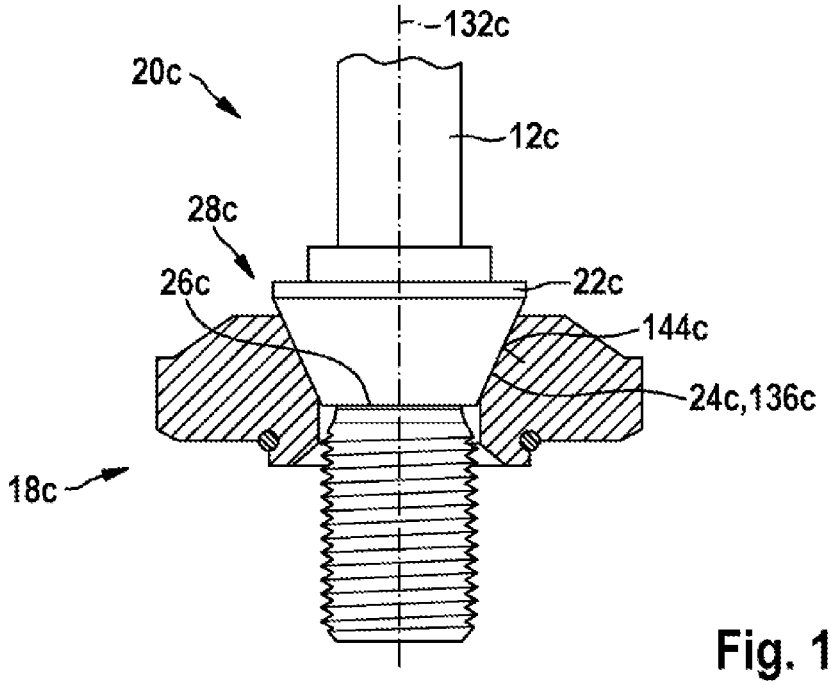
FIG. 11 shows a detail view of an alternative spindle and of an alternative runoff safety unit, which are each realized so as to be integral with an alternative coding element of the coding unit, in a schematic representation.

FIG. 11 shows an alternative coding unit 20*c*, which is provided to generate a coding between a spindle 12*c* and a runoff safety unit 18*c* of an angle grinder (not represented in greater detail here). The coding unit 20*c* is realized as a mechanical coding unit 20*c*. In this case, the coding unit 20*c* has a first coding element 22*c*, which is realized so as to be integral with the spindle 12*c*. The first coding element 22*c* has a geometric shape that has a basic circle 26*c* and a coding structure 28*c* that projects beyond the basic circle 26*c*. The coding structure 28*c* extends along a radial direction of the basic circle 26*c*. Further, the coding structure 28*c* is disposed in a region of the spindle 12*c* that is provided to receive the runoff safety unit 18*c* and/or to constitute a bearing contact surface of the spindle 12*c* for the purpose of axially supporting the runoff safety unit 18*c*. The coding structure 28*c* is disposed in a plane running parallelwise in relation to a surface surrounded by the basic circle 26*c*. A radial extent of the coding structure 28*c* in this case is greater than a radial extent of the surface surrounded by the basic circle 26*c*. Furthermore, the coding structure 28*c* and the basic circle 26*c*, as viewed along a rotation axis 132*c* of the spindle 12*c*, are connected to each other by means of a circumferential surface 144*c* of the coding element 22*c*. As a result, the coding structure 28*c*, the basic circle 26*c* and the circumferential surface 144*c* form a truncated cone, which is realized so as to be integral with the spindle 12*c*.

The coding unit 20*c* additionally has a second coding element 24*c*, which is constituted by an edge 136*c* that delimits a recess of the runoff safety unit 18*c*. The edge 136*c* has a conical course, relative to the rotation axis 132*c*. When the runoff safety unit 18*c* is in a mounted state, the first coding element 22*c*, realized as a truncated cone, bears against the edge 136*c*. The runoff safety unit 18*c* in this case is connected to the spindle 12*c* in a rotationally fixed manner.

Figure 12:
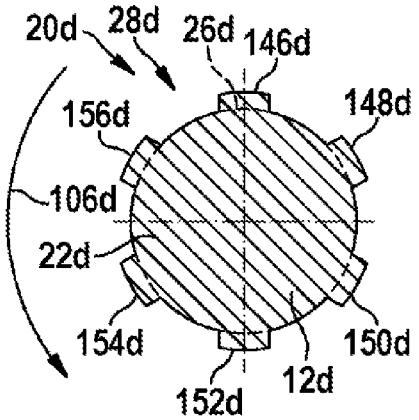
FIG. 12 shows a sectional view of an alternative coding element realized so as to be integral with a spindle of a power tool according to the disclosure, in a schematic representation.

FIG. 12 shows a sectional view of an alternative coding element 22*d* of an alternative coding unit 20*d*. The coding element 22*d* is realized so as to be integral with a spindle 12*d* of an angle grinder (not represented in greater detail here). The coding element 22*d* has a geometric shape that has a basic circle 26*d* and a coding structure 28*d* that projects beyond the basic circle 26*d*. The coding structure 28*d* extends along a radial direction of the basic circle 26*d*. The coding structure 28*d* comprises a multiplicity of drivers 146*d*, 148*d*, 150*d*, 152*d*, 154*d*, 156*d*, which are rectangular in form. The drivers 146*d*, 148*d*, 150*d*, 152*d*, 154*d*, 156*d* are disposed on the basic circle 26*d*, distributed uniformly along a circumferential direction 106*d*. The spindle 12*d* therefore has a spline profile for the purpose of enciphering an interface. A runoff safety unit (not represented in greater detail here) that can be mounted on the spindle 12*d* has a shape corresponding to the coding structure 28*d*, for the purpose of deciphering of the enciphered interface.

Figure 13:
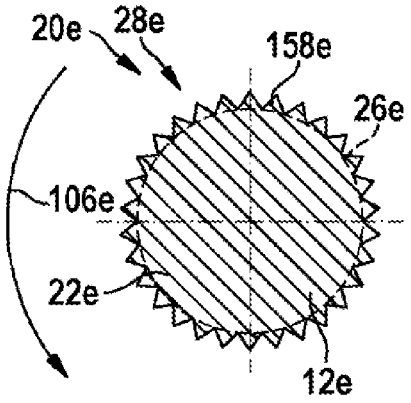
FIG. 13 shows a sectional view of a further alternative coding element realized so as to be integral with a spindle of a power tool according to the disclosure, in a schematic representation.

FIG. 13 shows a sectional view of an alternative coding element 22*e* of an alternative coding unit 20*e*. The coding element 22*e* is realized so as to be integral with a spindle 12*e* of an angle grinder (not represented in greater detail here). The coding element 22*e* has a geometric shape that has a basic circle 26*e* and a coding structure 28*e* that projects beyond the basic circle 26*e*. The coding structure 28*e* extends along a radial direction of the basic circle 26*e*. The coding structure 28*e* comprises a toothing 158*e*. The toothing 158*e* runs, along a circumferential direction 106*e*, on an outer surface of the spindle 12*e*. The spindle 12*e* therefore has a serrated shaft profile for the purpose of enciphering an interface. A runoff safety unit (not represented in greater detail here) that can be mounted on the spindle 12*e* has a shape corresponding to the coding structure 28*e*, for the purpose of deciphering of the enciphered interface.

Figure 14:
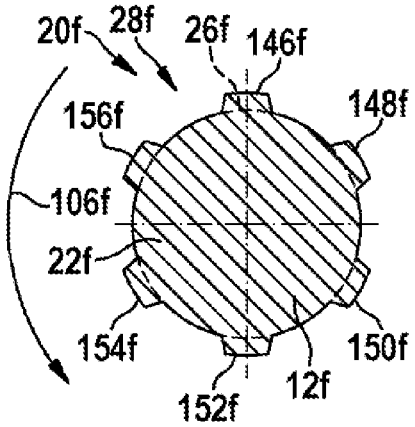
FIG. 14 shows a sectional view of a further alternative coding element realized so as to be integral with a spindle of a power tool according to the disclosure, in a schematic representation.

FIG. 14 shows a sectional view of an alternative coding element 22*f* of an alternative coding unit 20*f*. The coding element 22*f* is realized so as to be integral with a spindle 12*f* of an angle grinder (not represented in greater detail here). The coding element 22*f* has a geometric shape that has a basic circle 26*f* and a coding structure 28*f* that projects beyond the basic circle 26*f*. The coding structure 28*f* extends along a radial direction of the basic circle 26*f*. The coding structure 28*e* comprises a multiplicity of drivers 146*f*, 148*f*, 150*f*, 152*f*, 154*f*, 156*f*, the flanks of the drivers 146*f*, 148*f*, 150*f*, 152*f*, 154*f*, 156*f* being constituted by involutes. The drivers 146*f*, 148*f*, 150*f*, 152*f*, 154*f*, 156*f* are disposed on the basic circle 26*f*, distributed uniformly along a circumferential direction 106*f*. The spindle 12*f* therefore has an involute profile for the purpose of enciphering an interface. A runoff safety unit (not represented in greater detail here) that can be mounted on the spindle 12*f* has a shape corresponding to the coding structure 28*f*, for the purpose of deciphering the enciphered interface.

Figure 15:
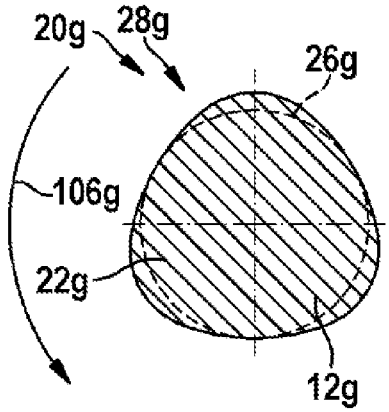
FIG. 15 shows a sectional view of a further alternative coding element realized so as to be integral with a spindle of a power tool according to the disclosure, in a schematic representation.

FIG. 15 shows a sectional view of an alternative coding element 22*g* of an alternative coding unit 20*g*. The coding element 22*g* is realized so as to be integral with a spindle 12*g* of an angle grinder (not represented in greater detail here).

The coding element 22*g* has a geometric shape that has a basic circle 26*g* and a coding structure 28*g* that projects beyond the basic circle 26*g*. The coding structure 28*g* extends along a radial direction of the basic circle 26*g*. The coding structure 28*g* is realized as a polygon having rounded corners. The spindle 12*g* therefore has a polygonal profile for the purpose of enciphering an interface. A runoff safety unit (not represented in greater detail here) that can be mounted on the spindle 12*g* has a shape corresponding to the coding structure 28*g*, for the purpose of deciphering the enciphered interface.

Figure 16:
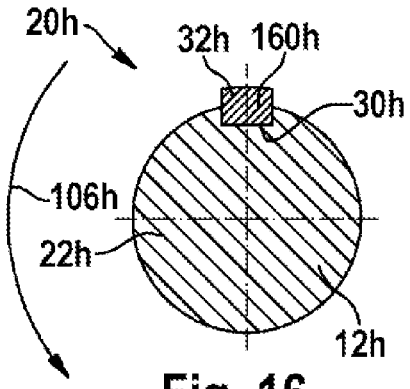
FIG. 16 shows a sectional view of a further alternative coding element realized so as to be integral with a spindle of a power tool according to the disclosure, in a schematic representation.

FIG. 16 shows a sectional view of an alternative coding element 22*h* of an alternative coding unit 20*h*. The coding element 22*h* is realized so as to be integral with a spindle 12*h* of an angle grinder (not represented in greater detail here). The coding element 22*h* comprises a longitudinal recess 30*h* for receiving a form-closure element 32*h* of the coding unit 20*h*. The form-closure element 32*h* is realized as a parallel key 160*h*. The parallel key 160*h*, when in a mounted state, extends parallelwise in relation to a rotation axis 132*h* of the spindle 12*h*. The spindle 12*h* therefore has a parallel-key connection for the purpose of enciphering an interface. A runoff safety unit (not represented in greater detail here) that can be mounted on the spindle 12*h* has an axial groove, realized so as to correspond to the parallel key 160*h*, for the purpose of deciphering the enciphered interface.

Figure 17:
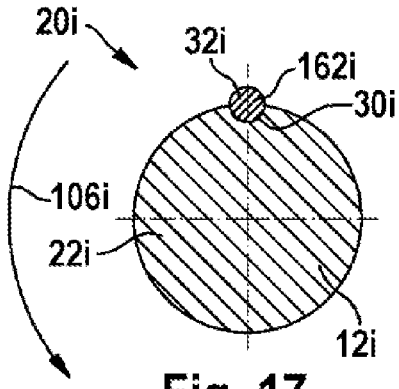
FIG. 17 shows a sectional view of a further alternative coding element realized so as to be integral with a spindle of a power tool according to the disclosure, in a schematic representation.

FIG. 17 shows a sectional view of an alternative coding element 22*i* of an alternative coding unit 20*i*. The coding element 22*i* is realized so as to be integral with a spindle 12*i* of an angle grinder (not represented in greater detail here). The coding element 22*i* comprises a longitudinal recess 30*i* for receiving a form-closure element 32*i* of the coding unit 20*h*. The form-closure element 32*i* is realized as a longitudinal pin 162*i*. The longitudinal pin 162*i*, when in a mounted state, extends parallelwise in relation to a rotation axis 132*i* of the spindle 12*i*. A runoff safety unit (not represented in greater detail here) that can be mounted on the spindle 12*i* has an axial groove, realized so as to correspond to the longitudinal pin 162*i*, for the purpose of deciphering the enciphered interface.

Figure 18:
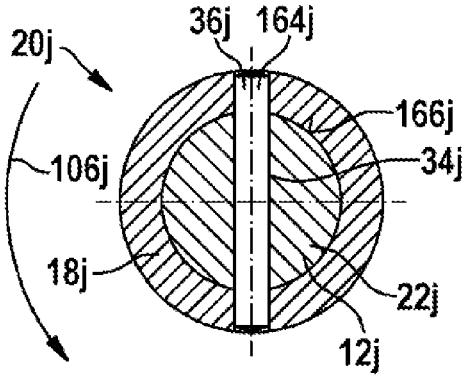
FIG. 18 shows a sectional view of a further alternative coding element realized so as to be integral with a spindle of a power tool according to the disclosure, in a schematic representation.

FIG. 18 shows a sectional view of an alternative coding element 22*j* of an alternative coding unit 20*j*. The coding element 22*j* is realized so as to be integral with a spindle 12*j* of an angle grinder (not represented in greater detail here). The coding element 22*j* comprises a transverse recess 34*j* for receiving a form-closure element 36*j* of the coding unit 20*j*. The form-closure element 36*j* is realized as a transverse pin 164*j*. The transverse pin 164*j*, when in a mounted state, extends perpendicularly in relation to a rotation axis 132*j* of the spindle 12*j*. The transverse pin extends along a direction perpendicular to the rotation axis 132*j*, on two sides, beyond an outer surface 166*j* of the spindle 12*j*. A runoff safety unit 18*j* (merely denoted) that can be mounted on the spindle 12*j* has two grooves for the purpose of deciphering the enciphered interface, which grooves are realized so as to correspond to regions of the transverse pin 164*j* that project on two sides beyond the outer surface 166*j* of the spindle.

Figure 19:
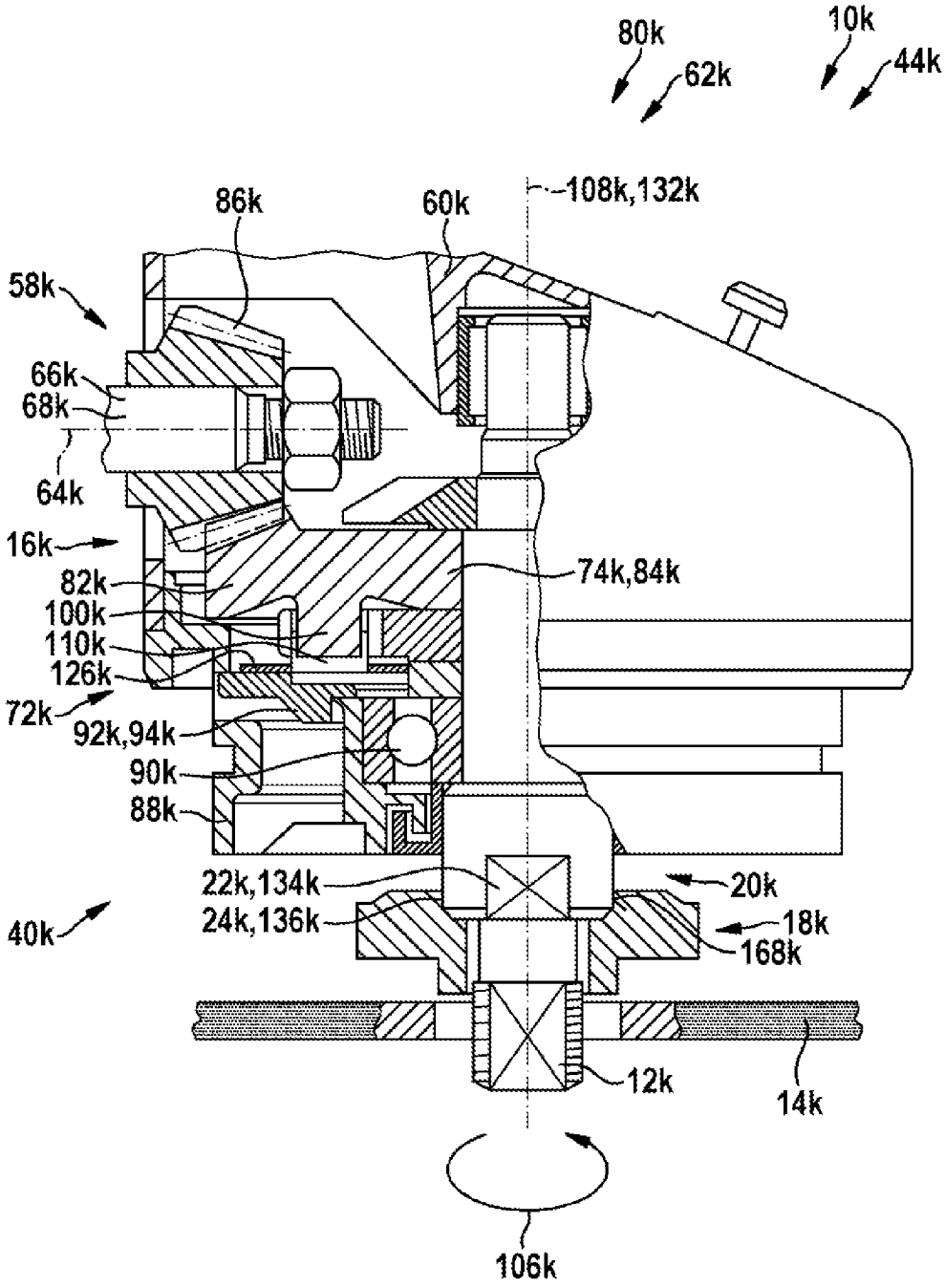
FIG. 19 shows an alternative power tool according to the disclosure, in a schematic representation.

FIG. 19 shows a portable power tool 10*k* that is realized as an angle grinder 44*k*. The angle grinder 44*k* is of a structure that is substantially similar to the angle grinder 44*a* from FIG. 1. The angle grinder 44*k* comprises a spindle 12*k* for receiving and driving a working tool 14*k*, and comprises a braking unit 16*k* provided to brake the spindle 12*k* and/or the working tool 14*k*, when in a braking mode. Further, the angle grinder 44*k* comprises a runoff safety unit 18*k*, which is provided to prevent the working tool 14*k* from running off the spindle 12*k*, at least when in the braking mode. The runoff safety unit 18*k* has a motion change unit (not represented in greater detail here), which is provided to change a first relative motion between two runoff safety elements (not represented in greater detail here) into a second relative motion, in the braking mode. The braking unit 16*k* is realized as a mechanical brake. In respect of a structure and functioning of the braking unit 16*k* of the hand power tool, reference may be made, in particular, to the publication DE 195 10 291 C2, the content of which, particularly with regard to the structure and functioning of the braking unit 16*k*, is to be considered to be a constituent part of the disclosure of the present document.

Furthermore, the angle grinder 44*k* has a coding unit 20*k*, which is provided to generate a coding at least between the spindle 12*k* and the runoff safety unit 18*k*. The coding unit 20*k* is realized as a mechanical coding unit 20*k*. Further, the coding unit 20*k* has a first coding element 22*k*, which is realized so as to be integral with the spindle 12*k*. The first coding element 22*k*, as viewed in a plane perpendicular to a rotation axis 132*k* of the spindle 12*k*, is realized as a circle segment 134*k* (cf. FIG. 8). When the spindle 12*k* is in a mounted state, the rotation axis 132*k* of the spindle 12*k* runs coaxially in relation to a rotation axis 108*k* of the ring gear 84*k*. The coding unit 20*k* additionally has a second coding element 24*k*, which is realized so as to be integral with the runoff safety unit 18*k*. The second coding element 24*k* in this case is realized as an edge 136*k* that delimits a recess of the runoff safety unit 18*k*. When the runoff safety unit 18*k* is in a mounted state, the recess of the runoff safety unit 18*k*, as viewed in a plane perpendicular to the rotation axis 132*k* of the spindle 12*k*, has a shape that corresponds to the circle segment 134*k*. When the runoff safety unit 18*k* has been mounted on the spindle 12*k*, the edge 136*k* that delimits the recess of the runoff safety unit 18*k* bears against an outer circumference 168*k* of the circle segment 134*k*. When in a mounted state, the circle segment 134*k* and the edge 136*k* that delimits the recess of the runoff safety unit 18*k* therefore constitute a form-closure connection. The outer circumference 168*k* of the circle segment 134*k* extends along the circumferential direction 106*k*, which runs in a plane perpendicular to the rotation axis 132*k* of the spindle. The coding unit 20*k* makes it possible to prevent components that have a recess of a shape differing from the shape of the circle segment 134*k* from being mounted.

Figure 20:
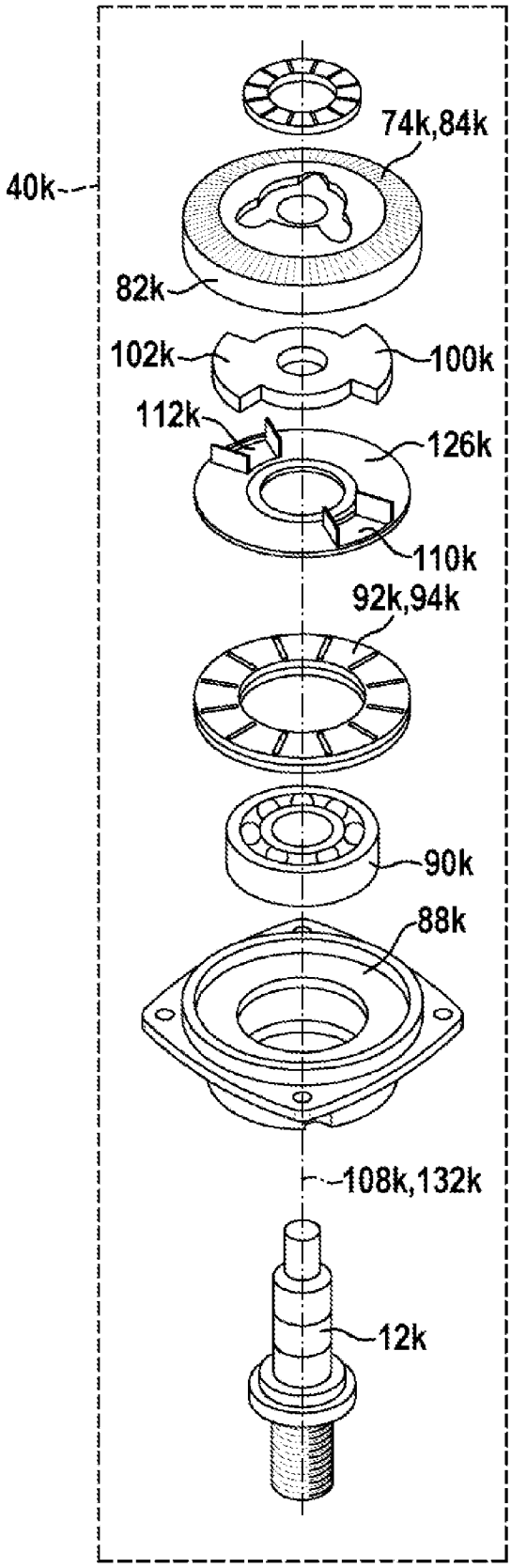
FIG. 20 shows a detail view of an output unit and of a braking unit of the power tool from FIG. 18, in a schematic representation.

FIG. 20 shows an exploded representation of the braking unit 62*k* that, together with an output unit 62*k* of the angle grinder 44*k*, is realized as a mountable module 40*k*. The mountable module 40*k* comprises four fastening elements (not represented in greater detail here), realized as screws. The screws are provided for detachably connecting the mountable module 40*k* to a transmission housing 60*k* of the angle grinder 44*k*. If necessary, an operator can demount the mountable module 40*k* from the transmission housing 60*k*. The angle grinder 44*k* and the mountable module 40*k* thus constitute a power tool system. The power tool system comprises a further mountable module (not represented in greater detail here). The further mountable module comprises an output unit, realized as a bevel gear transmission and decoupled from a braking unit. The further mountable module can be mounted on the transmission housing 60*k*, as an alternative to the mountable module 40*k*, by the operator.

The invention claimed is:

1. A portable power tool comprising:

at least one spindle configured to receive and drive a working tool;

at least one braking unit configured to brake at least one of the at least one spindle and the working tool, at least when in a braking mode;

at least one runoff safety unit configured to prevent the working tool from running off the at least one spindle, at least when in the braking mode;

a coding unit configured to generate a coding, at least between the at least one spindle and the at least one runoff safety unit such that the at least one spindle and the at least one runoff safety device have an enciphered interface.

2. The portable power tool as claimed in claim 1, wherein the coding unit includes a mechanical coding unit.

3. The portable power tool as claimed in claim 2, wherein the coding unit includes at least one coding element having a geometric shape defined by a basic circle and at least one coding structure projecting beyond the basic circle.

4. The portable power tool as claimed in claim 2, wherein:

the coding unit includes at least one coding element and a form-closure element, and the at least one coding element defines at least one longitudinal recess configured to receive the form-closure element.

5. The portable power tool as claimed in claim 2, wherein:

the coding unit includes at least one coding element and a form-closure element, and the at least one coding element defines at least one transverse recess configured to receive the form-closure element.

6. The portable power tool as claimed in claim 1, wherein the coding unit includes at least one of an electronic, an electrical, a magnetic, and an electromagnetic coding unit.

7. The portable power tool as claimed in claim 6, wherein the coding unit includes at least one RFID coding element supported on the at least one runoff safety unit.

8. The portable power tool as claimed in claim 1, wherein the braking unit includes a mechanical brake.

9. The portable power tool as claimed in claim 1, wherein the braking unit includes an electromagnetic brake.

10. The portable power tool as claimed in claim 1, wherein the braking unit is realized as a mountable module.

11. A power tool system, comprising:

a portable power tool having:

(i) at least one spindle configured to receive and drive a working tool;

(ii) at least one braking unit configured to brake at least one of the at least one spindle and the working tool, at least when in a braking mode, the at least one braking unit being realized as a mountable module; and (iii) at least one runoff safety unit configured to prevent the working tool from running off the at least one spindle, at least when in the braking mode; and at least one additional mountable module, wherein the at least one additional mountable module is configured to be mounted on the portable power tool as an alternative to the at least one braking unit.

* * * * *